United States Patent [19]

Bogner et al.

[11] 4,317,264

[45] Mar. 2, 1982

[54] MEANS AND METHOD FOR MAKING JEWELRY

[75] Inventors: Max Bogner, New York; Larry Grun, Rego Park, both of N.Y.

[73] Assignee: Four Stars Jewelry Corp., New York, N.Y.

[21] Appl. No.: 120,734

[22] Filed: Feb. 11, 1980

[51] Int. Cl.[3] ..... B23P 13/00

[52] U.S. Cl. ..... 29/8; 63/15; 59/91; D11/38

[58] Field of Search ..... 29/8; 63/3, 15–15.4; D11/38, 13; 59/80, 91

[56] References Cited

U.S. PATENT DOCUMENTS

| | | | |
|---|---|---|---|
| 133,146 | 11/1872 | Edge | 63/3 |
| 201,135 | 3/1878 | Verpillier | 59/80 |
| 1,394,877 | 10/1921 | Wood | 59/80 |
| 1,891,056 | 12/1932 | Schoeninger | 63/3 |
| 2,400,591 | 5/1946 | Nanasi | 59/91 X |
| 2,471,950 | 5/1949 | Gotti et al. | 59/80 |

FOREIGN PATENT DOCUMENTS

| | | | |
|---|---|---|---|
| 1093431 | 11/1954 | France | 63/3 |
| 506898 | 12/1954 | Italy | 63/3 |

*Primary Examiner*—Robert D. Baldwin
*Attorney, Agent, or Firm*—Charles E. Temko

[57] ABSTRACT

A means and method for making jewelry, particularly finger rings, the outer curvate surface of which is provided with a decorative band which, prior to installation is flexible along an axis perpendicular to its major axis to enable it to be fitted to the outer surface of a base member and maintained thereon by soldering or by the expansion of the base member to greater diameter.

5 Claims, 7 Drawing Figures

MEANS AND METHOD FOR MAKING JEWELRY

BACKGROUND OF THE INVENTION

This invention relates generally to the field of jewelry manufacture, and more particularly to an improved means and method for obtaining a finger ring or similar article having a unique appearance resembling, for example alligator hide or a similar texture on the outer surface of the article.

It is known in the art to manufacture finger rings by providing a generally cylindrical base member upon which decorative outer shells are mounted by soldering or by expanding the base member slightly to firmly grip the inner surface of the shell. The United States Patent to Eliasoff, U.S. Pat. No. 1,599,811 of Sept. 14, 1926 is one example of this type of construction.

However, most of the outer decorative elements are themselves castings or stampings, and the amount and character of the surface ornamentation available thereon is relatively limited. Simulation of linked structures such as chain mail, as well as other embellishment forms lack depth and realism. Further, when the outer decorative shell is formed from precious metals, often more of such a metal is used in the manufacture than is warranted. With the present cost of gold over $400 per troy ounce, the cost of such castings has limited practical use.

SUMMARY OF THE INVENTION

Briefly stated, the invention contemplates the provision of an improved means and method for manufacture of composite type jewelry articles. The decorative outer element or shell is formed as a plurality of linked structures interconnected in such manner that flexibility is obtained along an axis perpendicular to the principal axis of the element. Each of the links comprising the structure includes a transversely extending strip at one end thereof from which a plurality of identical or non-identical members extend along the principal axis of the element. Each of these members terminates in an elongated strip which is bent about the transversely extending strip of the next link in offset or staggered relation. When completed, the strip may be bent to cylindrical configuration and interconnected at the free ends thereof to form a sleeve which is slipped over the outer surface of the relatively rigid base and interconnected therewith by expanding the base or soldering the element thereto.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENTS

Figure 1:
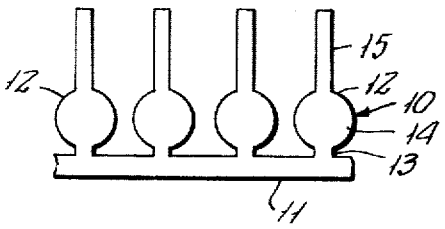
FIG. 1 is a view in elevation of a single element forming a part of a flexible strip of decorative material embodying the invention.

In accordance with the first embodiment of the invention, FIG. 1 discloses a basic element 10, in the form of a sheet metal stamping from precious or non-precious metal. The element 10 includes a transversely extending bar 11 supporting a plurality of decorative members 12, each having a connecting portion 13, a decorative portion 14, and an elongated terminal portion 15 disposed on a side of the decorative portion 14 opposite the portion 13. The decorative portion 14 is illustrated as having generally circular configuration.

Figure 2:
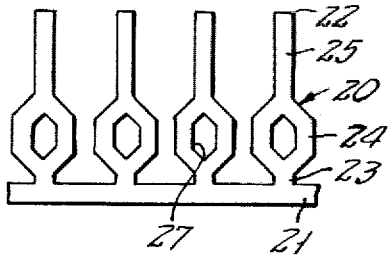
FIG. 2 is a view in elevation of an alternate form of single element comprising a second embodiment of the invention.

FIG. 2 illustrates an alternate form of basic element, generally indicated by reference character 20. It also includes a transversely extending bar 21, and a plurality of decorative members 22, each including a connecting portion 23, a decorative portion 24, and a terminal portion 25. The decorative portion 24 differs from that of the embodiment shown in FIG. 1 in that it is of six-sided elongated configuration having a centrally disposed opening 27. It will be understood by those skilled in the art that other forms of decorative portion may also be employed.

Figure 3:
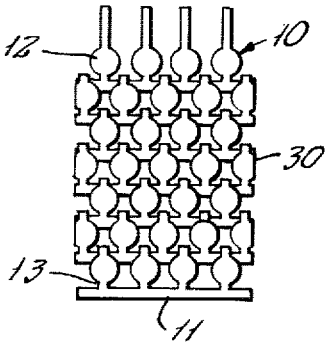
FIG. 3 is a view in elevation showing a plurality of elements as disclosed in FIG. 1 in mutually interconnected relation.
Figure 4:
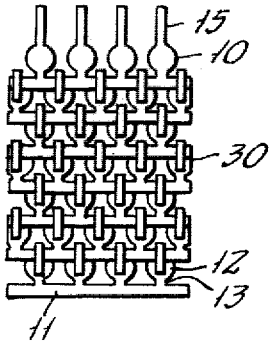
FIG. 4 is a view in elevation showing a side opposite that seen in FIG. 3.

Referring to FIGS. 3 and 4, the basic elements 10 are interconnected with each other by placing succeeding element in slightly staggered or offset relation, and bending the free ends of the terminal portions 15 about a transversely extending bar 11 of an adjacent element 10. The result is an elongated strip 30 having limited flexibility at the points of interconnection of the link which permits the strip to bend about spaced parallel axes perpendicular to the principal axis of the strip.

Figure 5:
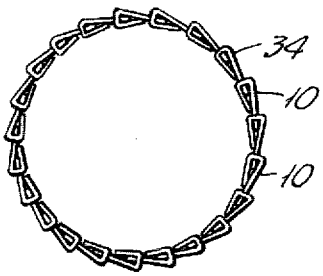
FIG. 5 is a side elevational view showing the element shown in FIGS. 3 and 4 with the free ends thereof in interconnected condition.

FIG. 5 illustrates the next step in the process which is the interconnection of the free end edges in a similar manner to form an annular unit 34.

Figure 6:
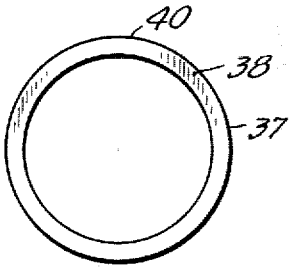
FIG. 6 is an end elevational view of a cylindrical base element forming a part of each of the disclosed embodiments.
Figure 7:
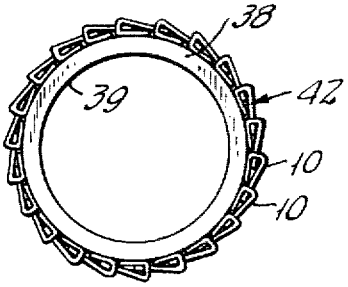
FIG. 7 is a side elevational view showing a completed first embodiment.

FIG. 6 illustrates a conventional cast ring base 37 bounded by a pair of end surfaces, one of which is indicated by reference character 38, an inner surface 39 and an outer surface 40. The unit 34 shown in FIG. 5 is dimensioned to closely correspond to the outer surface 40. It is slipped over the outer surface 40 and secured thereto by soldering or other well known means. The finished article is designated by reference character 42 in FIG. 7. As an alternate form of integration, where the base 37 is made of sufficient thinness, it may be expanded to frictionally grip the inner surface of the annular unit 34.

The embodiment shown in FIG. 2 may be treated in a similar fashion to result in a finished article having a different decorative appearance.

It will be understood by those skilled in the art that the application of the present invention is not confined to finger rings. The strip element 30, where desired, may be secured to a planar surface to make an attractive pin, brooch or similar article as well. By affixing an earring wire to an inner surface, and cutting the peripheral surfaces of the strip, an attractive earring may also be made.

We wish it to be understood that we do not consider the invention limited to the particular details of structure shown and set forth in this specification, for obvious modifications will occur to those skilled in the art to which the invention pertains.

We claim:

1. A decorative strip for use in manufacturing articles of jewelry, said strip having a principal axis and comprising a plurality of interconnected link elements; each of said link elements being formed from blanks of generally planar configuration and having an elongated bar extending transversely with respect to said principal axis at one end thereof, and a plurality of discrete decorative members unilaterally extending longitudinally with respect to said axis from said bar; said decorative members each having a connecting portion interconnecting with an edge of said bar, a decorative portion axially aligned with said connecting portion, and a bendable terminal portion extending longitudinally from an opposite end of said decorative portion; each said terminal portion being bent to hook-shaped configuration and engaging a portion of a transversely extending bar member of an adjacent link element in staggered relation.

2. A decorative strip in accordance with claim 1, further characterized in said decorative portions having a generally circular configuration.

3. A decorative strip in accordance with claim 1, further characterized in said decorative portions being of generally elongate configuration.

4. The method of making an article of jewelry comprising the steps of:

(a) providing a plurality of basic link element blanks of generally planar configuration, each including an elongated bar defining one edge thereof, and having a plurality of discrete decorative members extending in substantially parallel relation unilaterally from said edge, said decorative members having a bendable terminal portion on a free end thereof;

(b) interconnecting said link element blanks together by engaging said terminal portions of one link element with portions of the elongated bar of an adjacent link element in staggered relation to form a strip having a principal axis and capable of limited flexibility along axes perpendicular to said principal axis;

(c) providing a rigid base of desired configuration having an outer peripheral surface; and (d) securing said strip to said outer surface.

5. The method in accordance with claim 4, including the additional step of interconnecting the free end edges of said strip to form an endless band.

* * * * *